US010403998B2

(12) United States Patent
Hayashi et al.

(10) Patent No.: US 10,403,998 B2
(45) Date of Patent: Sep. 3, 2019

(54) FEMALE TERMINAL AND CONNECTOR

(71) Applicant: JAPAN AVIATION ELECTRONICS INDUSTRY, LIMITED, Shibuya-ku, Tokyo (JP)

(72) Inventors: Toshikazu Hayashi, Tokyo (JP); Masakazu Kuroiwa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/038,990

(22) Filed: Jul. 18, 2018

(65) Prior Publication Data

US 2019/0089082 A1 Mar. 21, 2019

(30) Foreign Application Priority Data

Sep. 21, 2017 (JP) ..... 2017-181276

(51) Int. Cl.
*H01R 13/187* (2006.01)
*H01R 13/11* (2006.01)

(52) U.S. Cl.
CPC ..... *H01R 13/187* (2013.01); *H01R 13/113* (2013.01); *H01R 13/114* (2013.01); *H01R 13/11* (2013.01)

(58) Field of Classification Search
CPC ..... H01R 13/113; H01R 13/10–13/187
USPC ..... 439/852, 843, 845, 847, 851
See application file for complete search history.

(56) References Cited

U.S. PATENT DOCUMENTS 3,836,947 A * 9/1974 Yeager ..... H01R 13/113 439/852
4,472,017 A * 9/1984 Sian ..... H01R 13/113 439/747
5,350,321 A * 9/1994 Takenouchi ..... H01R 13/115 439/839

(Continued)

FOREIGN PATENT DOCUMENTS

EP 2363921 A1 9/2011
JP H11224709 A 8/1999
JP H11233182 A 8/1999

OTHER PUBLICATIONS

Extended European Search Report (EESR) dated Feb. 13, 2019 issued in European Application No. 18185601.4.

*Primary Examiner* — Travis S Chambers
(74) *Attorney, Agent, or Firm* — Holtz, Holtz & Volek PC

(57) ABSTRACT

A female terminal comprises a main body, a main spring portion and an auxiliary spring portion. The main body forms a receiving portion. The receiving portion opens forward in a front-rear direction. The main spring portion has a first spring piece, a second spring piece and a contact portion. The contact portion is held between the first spring piece and the second spring piece in the front-rear direction. The auxiliary spring portion has a first support portion, a second support portion and a resilient supporting portion. The first support portion supports the first spring piece when a male terminal and the female terminal are connected with each other. The second support portion supports the second spring piece when the male terminal and the female terminal are connected with each other. The contact portion is positioned between the first support portion and the second support portion in the front-rear direction.

7 Claims, 6 Drawing Sheets

(56) References Cited

U.S. PATENT DOCUMENTS

| | | | | |
|---|---|---|---|---|
| 6,062,918 | A * | 5/2000 | Myer | H01R 13/187 439/833 |
| 6,547,608 | B2 * | 4/2003 | Sato | H01R 13/11 439/851 |
| 7,387,550 | B2 * | 6/2008 | Myer | H01R 13/113 439/852 |
| 7,938,695 | B2 | 5/2011 | Furutani et al. | |
| 8,241,077 | B2 | 8/2012 | Suzuki et al. | |
| 8,333,622 | B2 * | 12/2012 | Blasko | H01R 13/113 439/852 |
| 2010/0173539 | A1 | 7/2010 | Furutani et al. | |
| 2011/0212656 | A1 | 9/2011 | Suzuki et al. | |

* cited by examiner

FEMALE TERMINAL AND CONNECTOR

CROSS REFERENCE TO RELATED APPLICATIONS

This application is based on and claims priority under 35 U.S.C. § 119 to Japanese Patent Application No. JP2017-181276 filed Sep. 21, 2017, the contents of which are incorporated herein in their entireties by reference.

BACKGROUND OF THE INVENTION

This invention relates to a female terminal and a connector comprising the female terminal.

Referring to FIG. 10, JPA H11-233182 (Patent Document 1) discloses a female terminal 900 which comprises a main body 910, a main spring portion 920 and an auxiliary spring portion 940.

As shown in FIG. 10, the main body 910 forms a receiving portion 950. Specifically, the receiving portion 950 opens forward in a front-rear direction, or in an X-direction. The receiving portion 950 is configured to receive a male terminal (not shown) along the X-direction. The main spring portion 920 is supported by the main body 910 in a cantilever manner. The main spring portion 920 extends in the receiving portion 950. The main spring portion 920 has a first spring piece 922, a second spring piece 924 and a contact portion 925. The first spring piece 922 has a fixed end 923. The first spring piece 922 is held between the contact portion 925 and the fixed end 923 in the X-direction. The contact portion 925 is held between the first spring piece 922 and the second spring piece 924 in the X-direction. The auxiliary spring portion 940 has a first support portion 942 and a second support portion 944. Each of the first support portion 942 and the second support portion 944 is movable in an up-down direction perpendicular to the X-direction, or in a Z-direction. The first support portion 942 and the second support portion 944 support the first spring piece 922 when the male terminal (not shown) and the female terminal 900 are connected with each other. The contact portion 925 is positioned forward of any of the first support portion 942 and the second support portion 944 in the X-direction.

In the female terminal 900 of Patent Document 1, the main spring portion 920 is supported by the auxiliary spring portion 940 having the first support portion 942 and the second support portion 944. Accordingly, the contact portion 925 can be brought into contact with the male terminal (not shown) with sufficient contact pressure upon the connection of the male terminal (not shown) with the female terminal 900. However, the female terminal 900 of Patent Document 1 has a drawback that the main spring portion 920 is easy to be deformed plastically.

SUMMARY OF THE INVENTION

It is therefore an object of the present invention to provide a female terminal having a structure which prevents plastic deformation of a main spring portion. In addition, it is another object of the present invention to provide a connector comprising the female terminal.

One aspect of the present invention provides a female terminal comprising a main body, a main spring portion and an auxiliary spring portion. The main body forms a receiving portion. The receiving portion opens forward in a front-rear direction. The receiving portion is configured to receive a male terminal along the front-rear direction. The main spring portion is supported by the main body in a cantilever manner. The main spring portion extends in the receiving portion. The main spring portion has a first spring piece, a second spring piece and a contact portion. The contact portion is held between the first spring piece and the second spring piece in the front-rear direction. The contact portion is brought into contact with the male terminal when the male terminal is received in the receiving portion. The auxiliary spring portion has a first support portion, a second support portion and a resilient supporting portion. Each of the first support portion and the second support portion is supported by the resilient supporting portion. Each of the first support portion and the second support portion is movable at least in an up-down direction perpendicular to the front-rear direction. The first support portion supports the first spring piece when the male terminal and the female terminal are connected with each other. The second support portion supports the second spring piece when the male terminal and the female terminal are connected with each other. The contact portion is positioned between the first support portion and the second support portion in the front-rear direction.

When the male terminal is inserted into the female terminal 900 of Patent Document 1, the male terminal is brought into contact with the contact portion 925 and moves the contact portion 925 downward. Meanwhile, each of the first support portion 942 and the second support portion 944 supports the main spring portion 920 from below by being brought into contact with only the first spring piece 922 which is positioned between the contact portion 925 and the fixed end 923. Accordingly, the female terminal 900 has a structure in which the main spring portion 920 is easy to be deformed plastically.

On the contrary, the female terminal of the present invention has the feature that the contact portion of the main spring portion is positioned between the first support portion and the second support portion of the auxiliary spring portion in the front-rear direction. In addition, the female terminal of the present invention has the feature that, when the male terminal and the female terminal are connected with each other, the first support portion of the auxiliary spring portion supports the first spring piece of the main spring portion while the second support portion of the auxiliary spring portion supports the second spring piece of the main spring portion.

Accordingly, when the male terminal pushes the contact portion of the main spring portion of the female terminal upon the connection of the male terminal with the female terminal, the contact portion of the main spring portion is supported evenly by the first support portion and the second support portion of the auxiliary spring portion so as to be balanced in the front-rear direction. Thus, a stress, which occurs at the main spring portion upon the connection of the male terminal with the female terminal, is distributed to the first support portion and the second support portion of the auxiliary spring portion through the first spring piece and the second spring piece, so that the main spring portion of the female terminal can be prevented from being plastically deformed.

An appreciation of the objectives of the present invention and a more complete understanding of its structure may be had by studying the following description of the preferred embodiment and by referring to the accompanying drawings.

Figure 1:
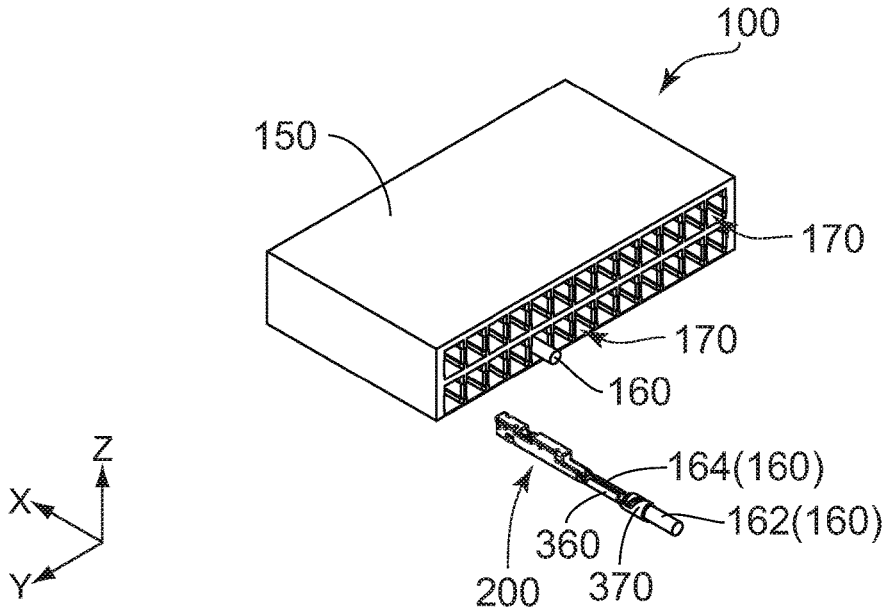
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 100 according to an embodiment of the present invention comprises a housing 150, a plurality of female terminals 200 and a plurality of cables 160. Referring to FIGS. 1, 2A, 2B and 9A, the connector 100 of the present embodiment is mateable with a mating connector (not shown) which comprises male terminals 700. Specifically, when the connector 100 and the mating connector of the present embodiment are mated with each other, the female terminals 200 of the connector 100 are connected with the male terminals 700, respectively, of the mating connector.

Figure 2A:
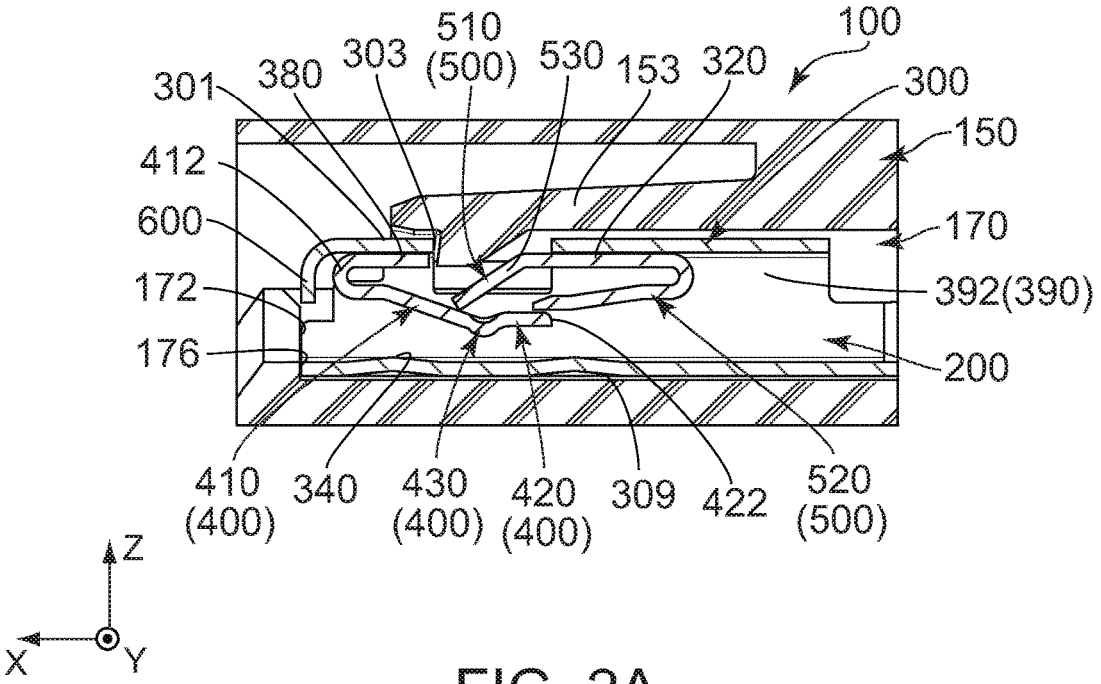
FIGS. 2A and 2B are a cross-sectional views showing a part of the connector of FIG. 1.

Referring to FIGS. 1 and 2A, the housing 150 of the present embodiment is made of insulator. Specifically, the housing 150 has a plurality of female terminal accommodating holes 170 and a plurality of lances 153.

As shown in FIG. 2A, each of the female terminal accommodating holes 170 of the present embodiment pierces the housing 150 in a front-rear direction. In the present embodiment, the front-rear direction is an X-direction. Specifically, it is assumed that forward is a positive X-direction while rearward is a negative X-direction.

Referring to FIGS. 1 and 2A, each of the female terminal accommodating holes 170 of the present embodiment has a right stopper 172, a left stopper (not shown) and a lower stopper 176. Each of the right stopper 172, the left stopper and the lower stopper 176 is a surface facing rearward in the front-rear direction. The right stopper 172, the left stopper and the lower stopper 176 define a front end of the female terminal accommodating hole 170 in the front-rear direction. The right stopper 172 is positioned right of the left stopper in a lateral direction. In the present embodiment, the lateral direction is a Y-direction. Specifically, rightward is a negative Y-direction while leftward is a positive Y-direction. The lower stopper 176 is positioned below any of the right stopper 172 and the left stopper in an up-down direction. In the present embodiment, the up-down direction is a Z-direction. Specifically, upward is a positive Z-direction while downward is a negative Z-direction.

Figure 2B:
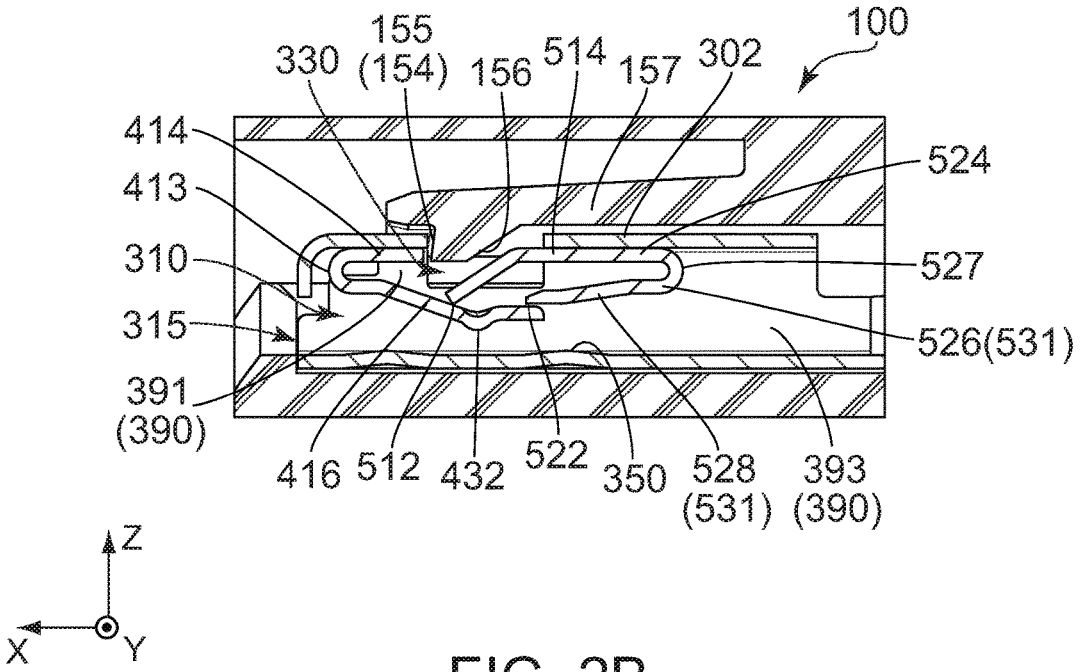
Figure 3:
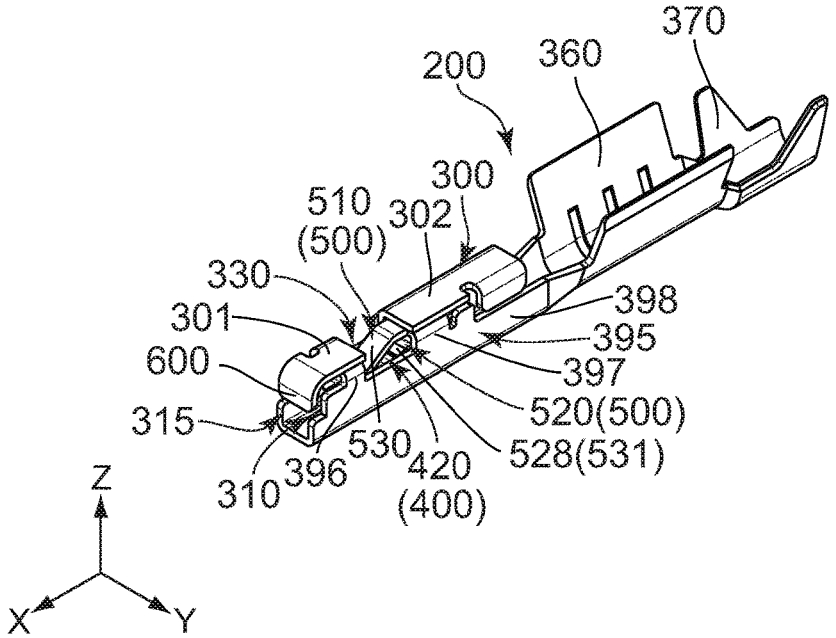
FIG. 3 is a perspective view showing a female terminal included in the connector of FIG. 1.

Referring to FIGS. 1 and 2A, the lances 153 correspond to the female terminal accommodating holes 170, respectively. As shown in FIGS. 2A and 2B, each of the lances 153 of the present embodiment has a protrusion 154 and a protrusion supporting portion 157. The protrusion supporting portion 157 extends forward so that a front end of the protrusion supporting portion 157 is a free end. The protrusion supporting portion 157 is elastically deformable. The protrusion 154 protrudes downward from around the front end of the protrusion supporting portion 157. The protrusion 154 is supported by the protrusion supporting portion 157 so as to be movable at least in the up-down direction. The protrusion 154 has a front surface 155 and a slope surface 156. The front surface 155 intersects with the front-rear direction. The slope surface 156 is positioned rearward of the front surface 155 in the front-rear direction. The slope surface 156 intersects with both the front-rear direction and the up-down direction.

As understood from FIGS. 1 and 2A, the housing 150 of the present embodiment holds the plurality of female terminals 200. Specifically, the female terminals 200 of the present embodiment are accommodated in the female terminal accommodating holes 170, respectively, of the housing 150 and are attached to the housing 150. A method of attaching the female terminal 200 to the housing 150 is described later.

Referring to FIGS. 2A to 9B, each of the female terminals 200 of the present embodiment is formed from a single metal plate. Specifically, each of the female terminals 200 comprises a main body 300, a main spring portion 400, a guard portion 600, an auxiliary spring portion 500, a core wire holding portion 360 and an outer cover holding portion 370.

As shown in FIGS. 2A to 9B, the main body 300 of the present embodiment has a first top portion 301, a second top portion 302, a right portion 390, a left portion 395, a bottom portion 309, a coupling portion 320, a main spring fixing portion 380, an opening 315 and a protrusion accommodating portion 330.

Referring to FIGS. 7 to 9B, each of the first top portion 301 and the second top portion 302 of the present embodiment has a plate-like shape perpendicular to the up-down direction. The first top portion 301 has a rear end 303 in the front-rear direction. Each of the first top portion 301 and the second top portion 302 defines an upper end of the main body 300 in the up-down direction. The first top portion 301 is positioned forward of the second top portion 302 in the front-rear direction. More specifically, in the front-rear direction, the first top portion 301 is spaced apart from the second top portion 302 and positioned forward therefrom. The first top portion 301 and the second top portion 302 are positioned at positions same as each other in the up-down direction. Specifically, the first top portion 301 and the second top portion 302 are positioned on a common plane perpendicular to the up-down direction.

As shown in FIGS. 4 to 6 and 8, the right portion 390 of the present embodiment has a plate-like shape perpendicular to the lateral direction. The right portion 390 defines a right end of the main body 300 in the lateral direction.

Figure 8:
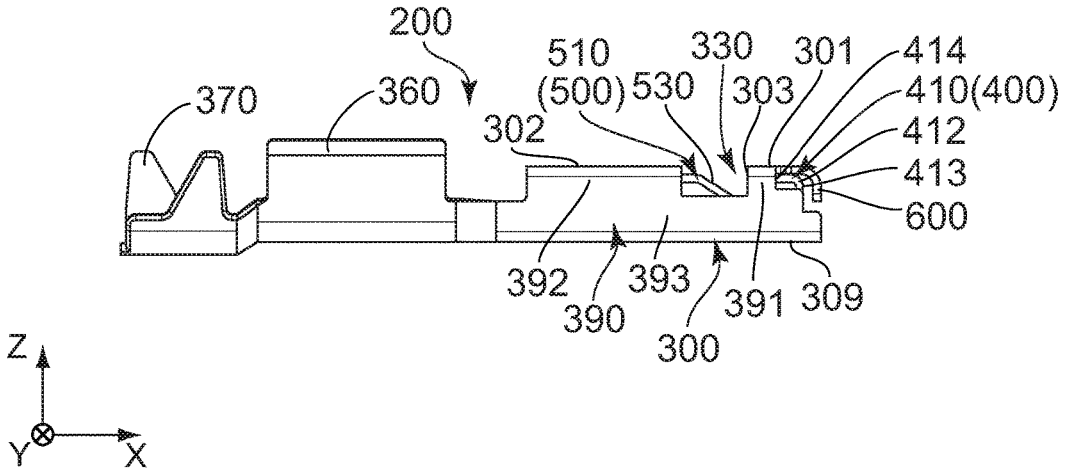
FIG. 8 is another side view showing the female terminal of FIG. 3.

As shown in FIG. 8, the right portion 390 of the present embodiment has a first right connecting portion 391, a second right connecting portion 392 and a right main portion 393. The first right connecting portion 391 is positioned forward of the second right connecting portion 392 in the front-rear direction. The first right connecting portion 391 extends upward from around a front end of the right main portion 393. The second right connecting portion 392 extends upward from a rear part of the right main portion 393.

Figure 5:
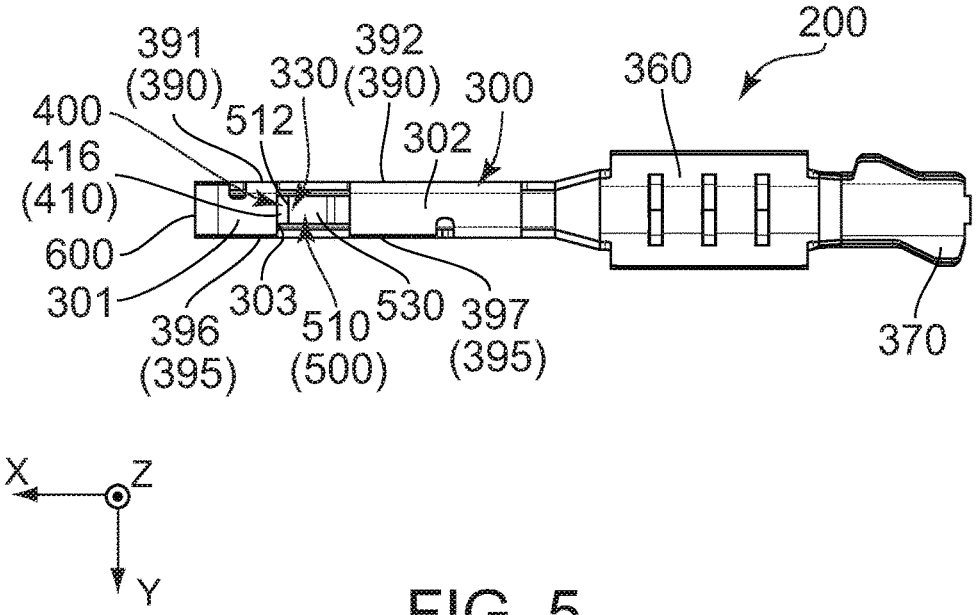
FIG. 5 is a top view showing the female terminal of FIG. 3.

Referring to FIGS. 5 and 8, each of the first top portion 301 and the second top portion 302 is connected with the right portion 390. More specifically, a right end of the first top portion 301 is connected with an upper end of the first right connecting portion 391 of the right portion 390, while a right end of the second top portion 302 is connected with an upper end of the second right connecting portion 392 of the right portion 390.

As shown in FIGS. 3 to 7, the left portion 395 of the present embodiment has a plate-like shape perpendicular to the lateral direction. The left portion 395 defines a left end of the main body 300 in the lateral direction. The left portion 395 is positioned left of the right portion 390 in the lateral direction.

Figure 7:
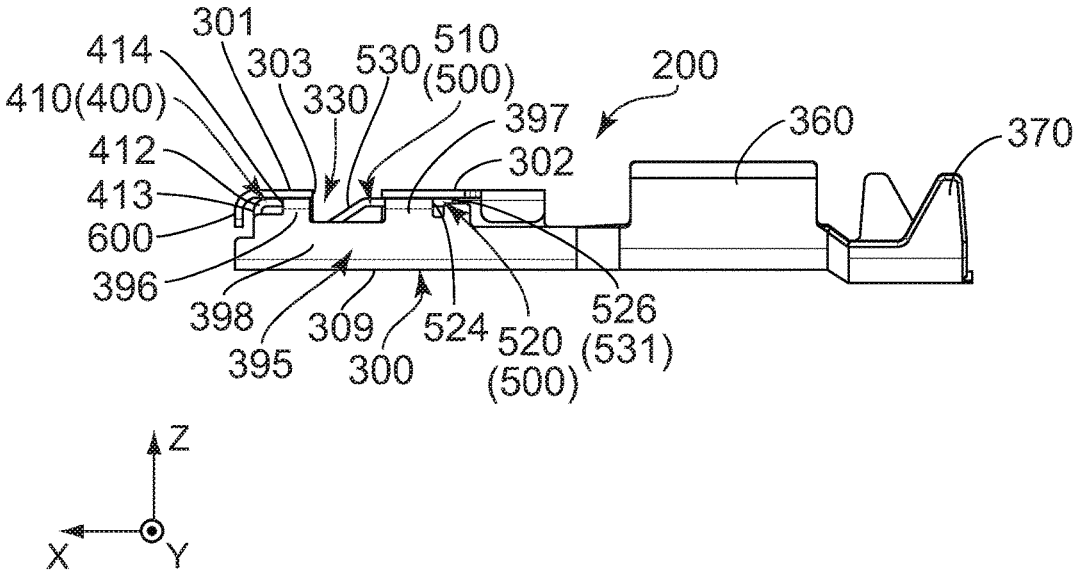
FIG. 7 is a side view showing the female terminal of FIG. 3.

As shown in FIG. 7, the left portion 395 of the present embodiment has a first left connecting portion 396, a second left connecting portion 397 and a left main portion 398. The first left connecting portion 396 is positioned forward of the second left connecting portion 397 in the front-rear direction. The first left connecting portion 396 extends upward from around a front end of the left main portion 398. The second left connecting portion 397 extends upward from a middle portion of the left main portion 398 in the front-rear direction.

As shown in FIGS. 4 and 6 to 9B, the bottom portion 309 of the present embodiment has a plate-like shape perpendicular to the up-down direction. The bottom portion 309 defines a lower end of the main body 300 in the up-down direction. The bottom portion 309 is positioned below any of the first top portion 301 and the second top portion 302 in the up-down direction. As shown in FIGS. 2A and 9A, the bottom portion 309 is provided with contact portions 340, 350. Each of the contact portions 340, 350 protrudes upward in the up-down direction. The contact portion 340 is positioned forward of the contact portion 350 in the front-rear direction.

Figure 4:
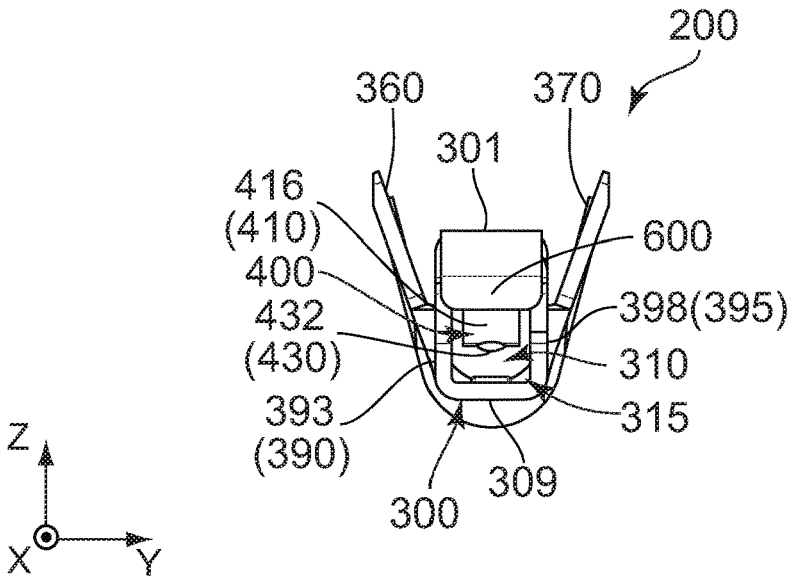
FIG. 4 is a front view showing the female terminal of FIG. 3.
Figure 6:
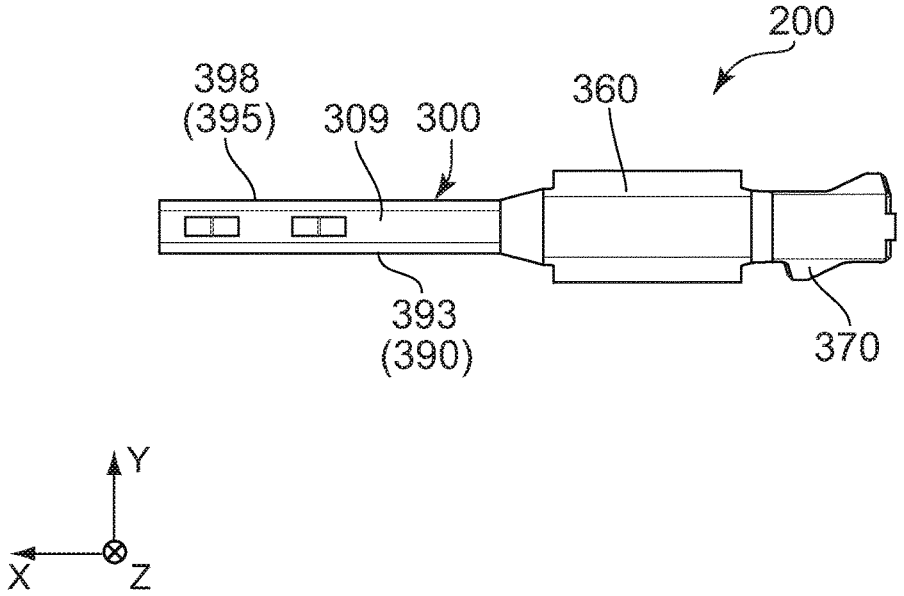
FIG. 6 is a bottom view showing the female terminal of FIG. 3.

As shown in FIGS. 4 and 6, a right end of the bottom portion 309 is connected with a lower end of the right main portion 393 of the right portion 390. In addition, a left end of the bottom portion 309 is connected with a lower end of the left main portion 398 of the left portion 395.

Figure 9A:
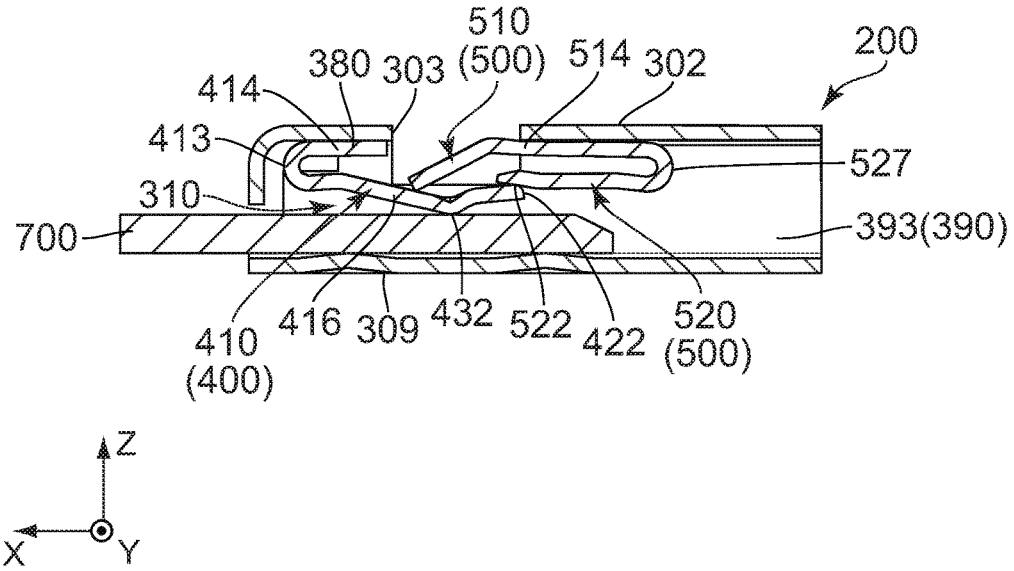
FIGS. 9A and 9B are cross-sectional views showing a part of the female terminal of FIG. 3, wherein a male terminal is inserted into a receiving portion of the female terminal.
Figure 9B:
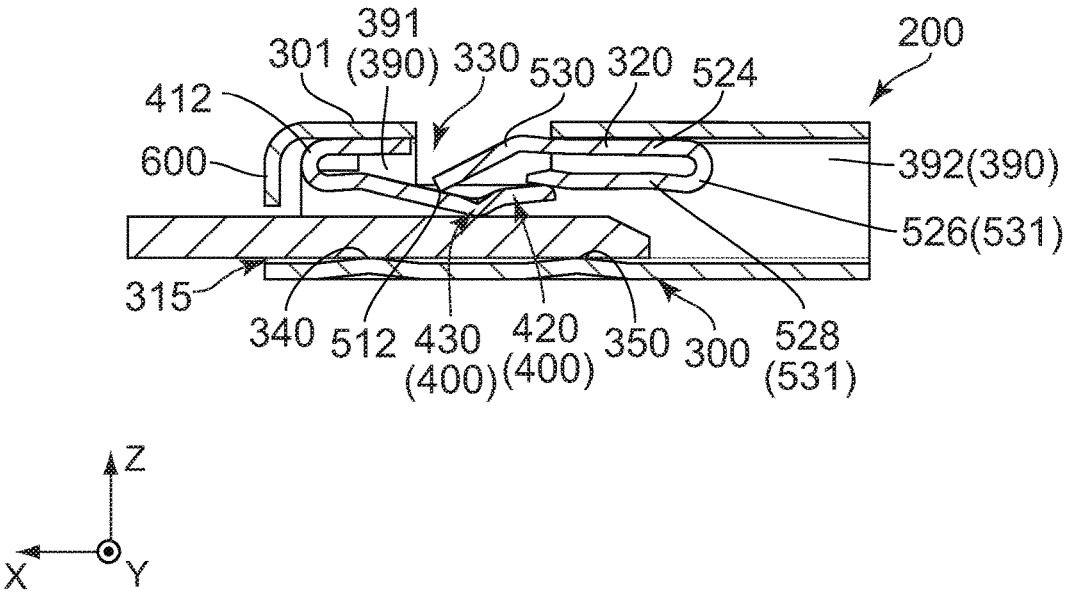
Figure 10:
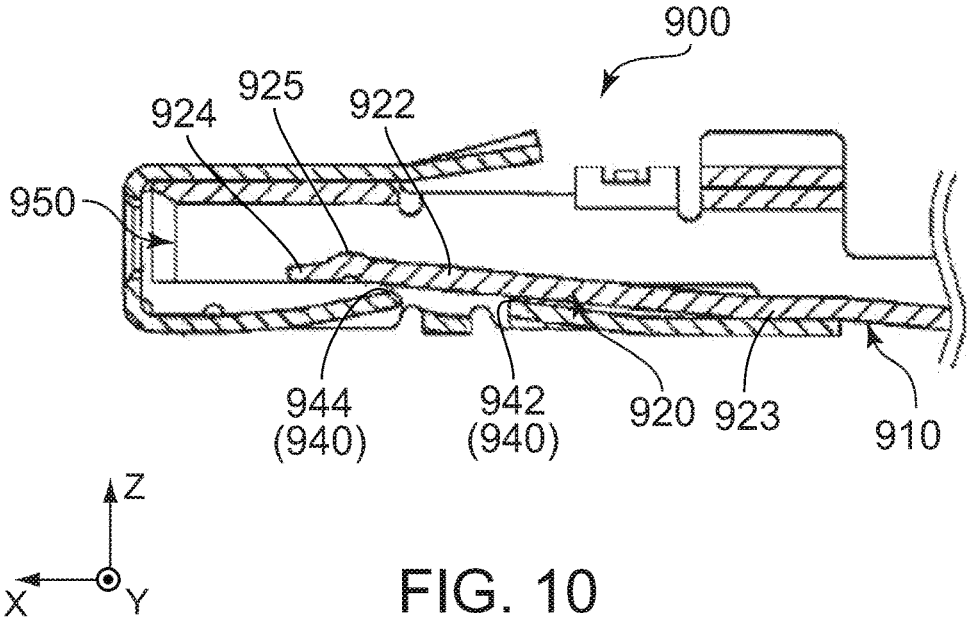
FIG. 10 PRIOR ART
FIG. 10 is a cross-sectional view showing a part of a female terminal of Patent Document 1.

Referring to FIGS. 2A and 9B, the coupling portion 320 of the present embodiment has a plate-like shape perpendicular to the up-down direction. Referring to FIG. 7, the coupling portion 320 is connected with the left portion 395 in the lateral direction. More specifically, a left end of the coupling portion 320 is connected with an upper end of the second left connecting portion 397 of the left portion 395. Referring to FIGS. 2A, 2B, 9A, and 9B, the coupling portion 320 is positioned below the second top portion 302 of the main body 300 in the up-down direction. The coupling portion 320 and the second top portion 302 are not brought into contact with each other in the up-down direction.

Referring to FIGS. 2A and 9A, the main spring fixing portion 380 of the present embodiment has a plate-like shape perpendicular to the up-down direction. Referring to FIG. 7, the main spring fixing portion 380 is connected with the left portion 395 in the lateral direction. More specifically, a left end of the main spring fixing portion 380 is connected with an upper end of the first left connecting portion 396 of the left portion 395. Referring to 2A and 9A again, the main spring fixing portion 380 is positioned below the first top portion 301 in the up-down direction.

Referring to FIGS. 2A to 9B, the first top portion 301, the second top portion 302, the right portion 390, the left portion 395, the bottom portion 309, the coupling portion 320 and the main spring fixing portion 380 of the main body 300 of the present embodiment form a structure which has a hollow, substantially rectangular tube shape extending in the front-rear direction. The structure, which is formed by the first top portion 301, the second top portion 302, the right portion 390, the left portion 395, the bottom portion 309, the coupling portion 320 and the main spring fixing portion 380, has the opening 315 at a front end thereof. In addition, a hollow space of the structure having the substantially rectangular tube shape forms a receiving portion 310 which receives the male terminal 700 when the male terminal 700 and the female terminal 200 are connected with each other. In other words, the main body 300 of the present embodiment forms the receiving portion 310 which opens forward in the front-rear direction and which is configured to receive the male terminal 700 along the front-rear direction.

As shown in FIGS. 2B, 3, 5 and 7 to 9B, the protrusion accommodating portion 330 of the present embodiment is positioned between the first top portion 301 and the second top portion 302 in the front-rear direction. As understood from FIG. 2, the protrusion accommodating portion 330 is a space which accommodates the protrusion 154 of the lance 153 of the housing 150 when the female terminal 200 is accommodated in the female terminal accommodating hole 170 of the housing 150.

Referring to FIGS. 2A, 7, 9A and 9B, the main spring portion 400 of the present embodiment is supported by the main body 300 in a cantilever manner. In addition, the main spring portion 400 of the present embodiment extends in the receiving portion 310 of the main body 300. The main spring portion 400 of the present embodiment is resiliently deformable.

As shown in FIGS. 2A, 9A and 9B, the main spring portion 400 of the present embodiment has a first spring piece 410, a bent portion 430 and a second spring piece 420.

As shown in FIGS. 2A, 9A and 9B, the first spring piece 410 of the present embodiment has a folded-back portion 412 and a linear portion 416.

As shown in FIGS. 2A, 2B, 9A and 9B, the folded-back portion 412 of the present embodiment has a shape which extends forward from the main spring fixing portion 380 of the main body 300 and which is then folded back to extend rearward. In detail, the folded-back portion 412 of the present embodiment has a substantially sideways U-shaped cross-section in a plane perpendicular to the lateral direction. A vertex 413 of the substantially sideways U-shaped cross-section of the folded-back portion 412 faces forward in the front-rear direction. Specifically, the vertex 413 is a front end of the folded-back portion 412 in the front-rear direction. In addition, the folded-back portion 412 of the present embodiment has a fixed end 414 which is connected with the main spring fixing portion 380 of the main body 300 in the front-rear direction. The folded-back portion 412 of the present embodiment is resiliently deformable with the fixed end 414 acting as a fulcrum.

As shown in FIGS. 2A, 2B, 4, 9A and 9B, the linear portion 416 of the present embodiment has a plate-like shape intersecting with both the up-down direction and the front-rear direction. The linear portion 416 of the present embodiment extends downward and rearward from the folded-back portion 412.

As shown in FIGS. 2A, 2B, 4, 9A and 9B, the bent portion 430 of the present embodiment extends rearward from a rear end of the linear portion 416 of the first spring piece 410. The bent portion 430 is positioned rearward of a rear end of the main spring fixing portion 380 of the main body 300 in the front-rear direction. In addition, the bent portion 430 is positioned rearward of the rear end 303 of the first top portion 301 of the main body 300 in the front-rear direction. A lower end of the bent portion 430 functions as a contact portion 432. In other words, the bent portion 430 of the present embodiment has the contact portion 432. The contact portion 432 of the present embodiment is supported by the first spring piece 410 so as to be movable in the up-down direction. Referring to FIGS. 9A and 9B again, as described later, the contact portion 432 of the present embodiment is brought into contact with the male terminal 700 when the male terminal 700 is received in the receiving portion 310. The contact portion 432 of the bent portion 430 of the main spring portion 400 of the present embodiment is positioned between the contact portions 340, 350 of the bottom portion 309 of the main body 300 in the front-rear direction. Specifically, in the front-rear direction, the contact portion 432 of the bent portion 430 of the main spring portion 400 of the present embodiment is positioned rearward of the contact portion 340 of the bottom portion 309 of the main body 300 and forward of the contact portion 350 of the bottom portion 309 of the main body 300. In addition, the contact portion 432 of the bent portion 430 of the main spring portion 400 of the present embodiment is positioned above any of the contact portions 340, 350 of the bottom portion 309 of the main body 300 in the up-down direction.

As shown in FIGS. 2A and 9A, the second spring piece 420 of the present embodiment has a plate-like shape intersecting with the up-down direction. The second spring piece 420 of the present embodiment extends rearward from a rear end of the bent portion 430. The second spring piece 420 is positioned rearward of the main spring fixing portion 380 of the main body 300 in the front-rear direction. The second spring piece 420 is positioned rearward of the rear end 303 of the first top portion 301 of the main body 300 in the front-rear direction.

As shown in FIGS. 2A and 9A, a rear end of the second spring piece 420 is a free end 422. In other words, the second spring piece 420 of the present embodiment has the free end 422. The free end 422 of the second spring piece 420 is positioned rearward of the rear end of the main spring fixing portion 380 of the main body 300 in the front-rear direction. The free end 422 of the second spring piece 420 is positioned rearward of the rear end 303 of the first top portion 301 of the main body 300 in the front-rear direction.

As shown in FIGS. 2A, 2B, 9A and 9B, the fixed end 414 of the main spring portion 400 is positioned forward of the free end 422 of the main spring portion 400 in the front-rear direction. In other words, the fixed end 414 of the folded-back portion 412 of the first spring piece 410 is positioned forward of the free end 422 of the second spring piece 420 in the front-rear direction.

As shown in FIGS. 2A, 2B, 9A and 9B, the contact portion 432 of the bent portion 430 of the present embodiment is held between the first spring piece 410 and the second spring piece 420 in the front-rear direction. More specifically, the contact portion 432 of the bent portion 430 is positioned rearward of the first spring piece 410 in the front-rear direction, and the second spring piece 420 is positioned rearward of the contact portion 432 of the bent portion 430 in the front-rear direction.

As shown in FIGS. 2A to 5 and 7 to 9B, the guard portion 600 of the present embodiment extends forward and downward from a front end of the first top portion 301 of the main body 300. More specifically, the guard portion 600 of the present embodiment has an upside down J-shaped cross-section in the plane perpendicular to the lateral direction. A lower end of the guard portion 600 is positioned below a lower end of the folded-back portion 412 of the first spring piece 410 of the main spring portion 400 in the up-down direction. The lower end of the guard portion 600 is positioned above the contact portion 432 of the bent portion 430 of the main spring portion 400 in the up-down direction.

As understood from FIGS. 2A to 4 and 7 to 9B, when the female terminal 200 is viewed from its front along the front-rear direction, the guard portion 600 hides the folded-back portion 412 of the main spring portion 400. In other words, when the female terminal 200 is viewed from its front along the front-rear direction, the folded-back portion 412 of the main spring portion 400 is invisible.

More specifically, as understood from FIGS. 2A to 4 and 7 to 9B, when the female terminal 200 is viewed from its front along the front-rear direction, the guard portion 600 hides the fixed end 414 of the main spring portion 400. In other words, when the female terminal 200 is viewed from its front along the front-rear direction, the fixed end 414 of the main spring portion 400 is invisible.

As shown in FIGS. 2A and 9A, the auxiliary spring portion 500 of the present embodiment has a first auxiliary spring portion 510 and a second auxiliary spring portion 520 which are independent of each other.

Referring to FIGS. 2A, 2B, 3, 7, 9A and 9B, the first auxiliary spring portion 510 of the present embodiment is supported by the main body 300 in a cantilever manner. The first auxiliary spring portion 510 has a first base portion 514, a first resilient supporting portion (resilient supporting portion) 530 and a first support portion 512. The first base portion 514 is a fixed end 514. In other words, the auxiliary spring portion 500 has the first support portion 512 and the resilient supporting portion 530.

As shown in FIGS. 2A, 2B, 9A and 9B, the first base portion 514 of the present embodiment is connected with a front end of the coupling portion 320 of the main body 300 in the front-rear direction.

As shown in FIGS. 2A, 2B, 9A and 9B, the first resilient supporting portion 530 of the present embodiment extends forward from the first base portion 514, which is the fixed end 514, and is then bent to extend forward and downward. Specifically, the first resilient supporting portion 530 of the present embodiment has a shape which is bent at an obtuse angle. The first resilient supporting portion 530 of the present embodiment is resiliently deformable with the fixed end 514 acting as a fulcrum.

As shown in FIGS. 2A, 2B, 9A and 9B, the first support portion 512 of the present embodiment is formed at a free end of the first auxiliary spring portion 510. The first support portion 512 is supported by the first resilient supporting portion 530. The first support portion 512 is movable at least in the up-down direction perpendicular to the front-rear direction. The first support portion 512 is positioned forward of the first base portion 514 in the front-rear direction. The first support portion 512 is positioned rearward of the folded-back portion 412 of the first spring piece 410 of the main spring portion 400 in the front-rear direction. The first support portion 512 is positioned forward of the bent portion 430 of the main spring portion 400 in the front-rear direction. Under a state where the female terminal 200 is not connected with the male terminal 700, the first support portion 512 is in contact with the first spring piece 410 of the main spring portion 400.

Referring to FIGS. 2A, 2B, 7, 9A and 9B, the second auxiliary spring portion 520 of the present embodiment is supported by the main body 300 in a cantilever manner. The second auxiliary spring portion 520 has a second base portion 524, a second resilient supporting portion (resilient supporting portion) 531 and a second support portion 522. The second base portion 524 is a fixed end. In other words, the auxiliary spring portion 500 has the second support portion 522 and the second resilient supporting portion 531. Since the auxiliary spring portion 500 has the first support portion 512 and the resilient supporting portion 530 as described above, the auxiliary spring portion 500 has the first support portion 512, the second support portion 522 and the two resilient supporting portions 530, 531. Specifically, the two resilient supporting portions 530, 531 include the first resilient supporting portion 530 and the second resilient supporting portion 531.

As shown in FIGS. 2A, 2B, 9A and 9B, the second base portion 524 of the present embodiment is connected with a rear end of the coupling portion 320 of the main body 300 in the front-rear direction. Since the first base portion 514 of the present embodiment is connected with the front end of the coupling portion 320 of the main body 300 in the front-rear direction as described above, the coupling portion 320 of the present embodiment couples the first base portion 514 and the second base portion 524 with each other in the front-rear direction.

As shown in FIGS. 2B and 9B, the second resilient supporting portion 531 of the present embodiment extends from the second base portion 524 which is the fixed end. Specifically, the second resilient supporting portion 531 has a folded-back portion 526 and a linear portion 528. The second resilient supporting portion 531 of the present embodiment is resiliently deformable with the second base portion 524 acting as a fulcrum.

As shown in FIGS. 2B, 9A and 9B, the folded-back portion 526 of the present embodiment has a shape which extends rearward from the second base portion 524 and which is then folded back to extend forward. In detail, the folded-back portion 526 of the present embodiment has a substantially sideways U-shaped cross-section in the plane perpendicular to the lateral direction. A vertex 527 of the substantially sideways U-shaped cross-section of the folded-back portion 526 faces rearward in the front-rear direction. Specifically, the vertex 527 is a rear end of the folded-back portion 526 in the front-rear direction.

As shown in FIGS. 2A and 9B, the linear portion 528 of the present embodiment has a substantially plate-like shape intersecting with both the up-down direction and the front-rear direction. The linear portion 528 extends forward from the folded-back portion 526.

As shown in FIGS. 2A, 2B, 9A and 9B, the second support portion 522 of the present embodiment is formed at a free end 522 of the second auxiliary spring portion 520. The second support portion 522 is supported by the second resilient supporting portion 531. The second support portion 522 is movable at least in the up-down direction perpendicular to the front-rear direction. More specifically, the second support portion 522 is supported by the linear portion 528 of the second resilient supporting portion 531 and is movable at least in the up-down direction. The second support portion 522 is positioned forward of the second base portion 524 in the front-rear direction. In addition, the second support portion 522 is positioned forward of the first base portion 514 of the first auxiliary spring portion 510 in the front-rear direction. The second support portion 522 is positioned rearward of the bent portion 430 of the main spring portion 400 in the front-rear direction. The second support portion 522 is positioned forward of the rear end 422 of the second spring piece 420 of the main spring portion 400 in the front-rear direction. Under the state where the female terminal 200 is not connected with the male terminal 700, the second support portion 522 is not in contact with the second spring piece 420 of the main spring portion 400.

As shown in FIGS. 2A, 2B, 9A and 9B, the contact portion 432 of the bent portion 430 of the main spring portion 400 of the present embodiment is positioned between the first support portion 512 and the second support portion 522 of the auxiliary spring portion 500 in the front-rear direction. More specifically, in the front-rear direction, the contact portion 432 of the bent portion 430 of the main spring portion 400 of the present embodiment is positioned rearward of the first support portion 512 of the auxiliary spring portion 500 and forward of the second support portion 522 of the auxiliary spring portion 500.

As shown in FIGS. 1 and 3 to 8, the core wire holding portion 360 of the present embodiment is positioned rearward of the main body 300 in the front-rear direction. The core wire holding portion 360 extends rearward in the front-rear direction. The core wire holding portion 360 has a substantially rounded V-shaped cross-section in a plane perpendicular to the front-rear direction.

As shown in FIGS. 1 and 3 to 8, the outer cover holding portion 370 of the present embodiment is positioned rearward of the core wire holding portion 360 in the front-rear direction. The outer cover holding portion 370 defines a rear end of the female terminal 200.

As shown in FIG. 1, the cable 160 of the present embodiment extends in the front-rear direction. Specifically, the cable 160 has an outer cover 162 and a core wire 164. The cable 160 is attached to the female terminal 200. More specifically, the outer cover 162 of the cable 160 is held by the outer cover holding portion 370 of the female terminal 200, while the core wire 164 of the cable 160 is held by the core wire holding portion 360 of the female terminal 200.

A method of attaching the female terminal 200 to the housing 150 is described below.

First, referring to FIGS. 1, 2A and 2B, a front end of the female terminal 200, to which the cable 160 is attached, is inserted forward from a rear end of the female terminal accommodating hole 170 of the housing 150 into the female terminal accommodating hole 170. Then, the female terminal 200 is moved forward inside the female terminal accommodating hole 170 of the housing 150 and the guard portion 600 of the female terminal 200 is brought into contact with the slope surface 156 of the protrusion 154 of the lance 153 of the housing 150.

Next, when the female terminal 200 is further moved forward, the guard portion 600 of the female terminal 200 pushes the slope surface 156 of the protrusion 154 of the lance 153 of the housing 150 to elastically deform the protrusion supporting portion 157 of the lance 153, so that the protrusion 154 is moved upward.

When the female terminal 200 is still further moved forward under this state, the female terminal 200 is moved further forward inside the female terminal accommodating hole 170 of the housing 150 while the first top portion 301 of the female terminal 200 is in contact with a lower surface of the protrusion 154. After that, when the rear end 303 of the first top portion 301 of the main body 300 of the female terminal 200 and the front surface 155 of the protrusion 154 of the lance 153 of the housing 150 reach the same relative position in the front-rear direction, the protrusion supporting portion 157 of the lance 153 of the housing 150 restores its original shape so that the protrusion 154 of the lance 153 of the housing 150 is accommodated in the protrusion accommodating portion 330 of the main body 300 of the female terminal 200.

Meanwhile, the front surface 155 of the protrusion 154 of the lance 153 of the housing 150 faces the rear end 303 of the first top portion 301 of the main body 300 of the female terminal 200 in the front-rear direction.

Also meanwhile, a front end of the bottom portion 309 of the main body 300 of the female terminal 200 faces the lower stopper 176 of the female terminal accommodating hole 170 of the housing 150 in the front-rear direction. In addition, a front end of the right portion 390 of the main body 300 of the female terminal 200 faces the right stopper 172 of the female terminal accommodating hole 170 of the housing 150 in the front-rear direction while a front end of the left portion 395 of the main body 300 of the female terminal 200 faces the left stopper of the female terminal accommodating hole 170 of the housing 150 in the front-rear direction.

Even if the female terminal 200 is tried to be removed rearward from the female terminal accommodating hole 170 of the housing 150 under this state, the rear end 303 of the first top portion 301 of the main body 300 of the female terminal 200 is brought into contact with the front surface 155 of the protrusion 154 of the lance 153 of the housing 150 in the front-rear direction. Accordingly, the female terminal 200 is prevented from being removed rearward therefrom. Similarly, even if the female terminal 200 is tried to be removed forward from the female terminal accommodating hole 170 of the housing 150 under this state, the front ends of the right portion 390, the left portion 395 and the bottom portion 309 of the main body 300 of the female terminal 200 are brought into contact with the right stopper 172, the left stopper and the lower stopper 176, respectively, of the female terminal accommodating hole 170 of the housing 150. Accordingly, the female terminal 200 is prevented from being removed forward therefrom. Thus, each of the female terminals 200 is held by the housing 150 under this state.

A method of connecting the male terminal 700 with the female terminal 200 and a movement of each part of the female terminal 200 upon the connection of the male terminal 700 with the female terminal 200 are described below.

First, referring to FIGS. 9A and 9B, a free end, or a rear end, of the male terminal 700 and the opening 315 of the female terminal 200 are positioned so as to face each other in the front-rear direction.

Next, the male terminal 700 is moved rearward relative to the female terminal 200 along the front-rear direction, so that the male terminal 700 is inserted into the receiving portion 310 of the main body 300 of the female terminal 200 through the opening 315.

Meanwhile, a slope surface of the male terminal 700, which is positioned at an upper part of its rear end, is brought into contact with the contact portion 432 of the bent portion 430 of the main spring portion 400 of the female terminal 200 to push it, and the contact portion 432 is then moved upward in the up-down direction. When the contact portion 432 is moved upward, each of the first spring piece 410 and the second spring piece 420 is also moved upward.

Meanwhile, when the first spring piece 410 of the main spring portion 400 is moved upward, the first support portion 512 of the first auxiliary spring portion 510 of the auxiliary spring portion 500 is moved upward while maintaining contact with the first spring piece 410 of the main spring portion 400. In other words, the first support portion 512 supports the first spring piece 410 when the male terminal 700 and the female terminal 200 are connected with each other.

Also meanwhile, when the second spring piece 420 of the main spring portion 400 is moved upward, the second spring piece 420 of the main spring portion 400 is brought into contact with the second support portion 522 of the second auxiliary spring portion 520 of the auxiliary spring portion 500 to move the second support portion 522 upward. In other words, the second support portion 522 supports the second spring piece 420 when the male terminal 700 and the female terminal 200 are connected with each other.

In the female terminal 200 of the present embodiment, when the male terminal 700 pushes the contact portion 432 of the main spring portion 400 of the female terminal 200 upon the connection of the male terminal 700 with the female terminal 200, the contact portion 432 of the main spring portion 400 is supported evenly by the first support portion 512 and the second support portion 522 of the auxiliary spring portion 500 so as to be balanced in the front-rear direction. Accordingly, a stress, which occurs at the main spring portion 400 upon the connection of the male terminal 700 with the female terminal 200, is distributed to the first support portion 512 and the second support portion 522 of the auxiliary spring portion 500, so that the main spring portion 400 of the female terminal 200 can be prevented from being plastically deformed.

When the male terminal 700 is completely inserted into the receiving portion 310 of the main body 300 of the female terminal 200, the male terminal 700 and the female terminal 200 are in a state shown in FIGS. 9A and 9B. Specifically, under this state, the first support portion 512 of the first auxiliary spring portion 510 of the auxiliary spring portion 500 is kept in contact with the first spring piece 410 of the main spring portion 400 while the second support portion 522 of the second auxiliary spring portion 520 of the auxiliary spring portion 500 is kept in contact with the second spring piece 420 of the main spring portion 400. Additionally, under this state, the male terminal 700 is in contact with the main body 300 of the female terminal 200 at three points which are the contact portion 432 of the bent portion 430 of the main spring portion 400 and the contact portions 340, 350 of the bottom portion 309 of the main body 300 of the female terminal 200. Accordingly, the male terminal 700 can be reliably in contact with the female terminal 200 under this state.

Although the specific explanation about the present invention is made above referring to the embodiments, the present invention is not limited thereto and is susceptible to various modifications and alternative forms.

In the auxiliary spring portion 500 of the present embodiment, the first support portion 512 is supported by the resilient supporting portion 530 in a cantilever manner while the second support portion 522 is supported by the resilient supporting portion 531 in a cantilever manner, wherein the resilient supporting portions 530, 531 are independent of each other. However, the present invention is not limited thereto. The first support portion 512 may be supported by a resilient supporting portion in a fixed-fixed beam arrangement while the second support portion 522 may be supported by another resilient supporting portion in a fixed-fixed beam arrangement, wherein the resilient supporting portion and the another resilient supporting portion are independent of each other. In addition, each of the first support portion 512 and the second support portion 522 may be supported by a single resilient supporting portion in a cantilever manner. Specifically, the auxiliary spring portion 500 may have the first support portion 512, the second support portion 522 and the single resilient supporting portion. Furthermore, each of the first support portion 512 and the second support portion 522 may be supported by a single resilient supporting portion in a fixed-fixed beam arrangement. Specifically, the auxiliary spring portion 500 may have the first support portion 512, the second support portion 522 and the single resilient supporting portion.

Although, in the present embodiment, the first support portion 512 of the first auxiliary spring portion 510 of the auxiliary spring portion 500 of the female terminal 200 is in contact with the first spring piece 410 of the main spring portion 400 under the state where the female terminal 200 is not connected with the male terminal 700, the present invention is not limited thereto. Specifically, the first support portion 512 of the first auxiliary spring portion 510 of the auxiliary spring portion 500 of the female terminal 200 may not be in contact with the first spring piece 410 of the main spring portion 400 under the state where the female terminal 200 is not connected with the male terminal 700.

Although, in the present embodiment, the second support portion 522 of the second auxiliary spring portion 520 of the auxiliary spring portion 500 of the female terminal 200 is not in contact with the second spring piece 420 of the main spring portion 400 under the state where the female terminal 200 is not connected with the male terminal 700, the present invention is not limited thereto. Specifically, the second support portion 522 of the second auxiliary spring portion 520 of the auxiliary spring portion 500 may be in contact with the second spring piece 420 of the main spring portion 400 under the state where the female terminal 200 is not connected with the male terminal 700.

Although, in the present embodiment, the fixed end 414 of the main spring portion 400 is positioned forward of the free end 422 of the main spring portion 400 in the front-rear direction, the present invention is not limited thereto. Specifically, the fixed end 414 of the main spring portion 400 may be modified to be positioned rearward of the free end 422 of the main spring portion 400 in the front-rear direction. More specifically, the main spring portion 400 may be modified to extend forward from a rear of the female terminal 200 in the receiving portion 310. However, if the main spring portion 400 is modified as described above, in order to prevent the modified main spring portion 400 from being buckled by the rear end of the male terminal 700 being brought into contact with a free end of the modified main spring portion 400 of the female terminal 200 upon the insertion of the male terminal 700 into the female terminal 200, the guard portion 600 is required to have an increased size so as to hide the free end of the modified main spring portion 400 when the female terminal 200 is viewed from its front. On the contrary, in the main spring portion 400 of the present embodiment, it is sufficient that the guard portion 600 is configured so as to guard the fixed end 414 of the main spring portion 400. Accordingly, the guard portion 600 can have a reduced size in the up-down direction in comparison with the assumption where the main spring portion 400 extend forward from the rear of the female terminal 200 in the receiving portion 310, so that the opening 315 can have an increased size in the up-down direction. Thus, the main spring portion 400 of the present embodiment is preferred.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A female terminal comprising a main body, a main spring portion and an auxiliary spring portion, wherein:

the main body forms a receiving portion;

the receiving portion opens forward in a front-rear direction;

the receiving portion is configured to receive a male terminal along the front-rear direction;

the main spring portion is supported by the main body in a cantilever manner;

the main spring portion extends in the receiving portion;

the main spring portion has a first spring piece, a second spring piece and a contact portion;

the contact portion is held between the first spring piece and the second spring piece in the front-rear direction;

the contact portion is brought into contact with the male terminal when the male terminal is received in the receiving portion;

the auxiliary spring portion has a first support portion, a second support portion and a resilient supporting portion;

each of the first support portion and the second support portion is supported by the resilient supporting portion;

each of the first support portion and the second support portion is movable at least in an up-down direction perpendicular to the front-rear direction;

the first support portion supports the first spring piece when the male terminal and the female terminal are connected with each other;

the second support portion supports the second spring piece when the male terminal and the female terminal are connected with each other;

the contact portion is positioned between the first support portion and the second support portion in the front-rear direction;

the auxiliary spring portion has a first auxiliary spring portion and a second auxiliary spring portion which are independent of each other;

each of the first auxiliary spring portion and the second auxiliary spring portion is supported by the main body in a cantilever manner;

the first auxiliary spring portion has a first base portion and a free end;

the first base portion is a fixed end;

the second auxiliary spring portion has a second base portion and a free end;

the second base portion is a fixed end;

the first support portion is formed at the free end of the first auxiliary spring portion; and the second support portion is formed at the free end of the second auxiliary spring portion.

2. The female terminal as recited in claim 1, wherein:

the first support portion is positioned forward of the first base portion in the front-rear direction; and the second support portion is positioned forward of the second base portion in the front-rear direction.

3. The female terminal as recited in claim 1, wherein:

the main body further has a coupling portion; and the coupling portion couples the first base portion and the second base portion with each other in the front-rear direction.

4. The female terminal as recited in claim 1, wherein the female terminal is formed from a single metal plate.

5. A connector comprising the female terminal as recited in claim 1 and a housing which holds the female terminal.

6. The female terminal as recited in claim 1, wherein:

the main spring portion has a fixed end and a free end; and the fixed end of the main spring portion is positioned forward of the free end of the main spring portion in the front-rear direction.

7. The female terminal as recited in claim 6, wherein:

the female terminal further has a guard portion; and the guard portion hides the fixed end of the main spring portion when the female terminal is viewed from the front thereof along the front-rear direction.

* * * * *